US005083672A

United States Patent [19]

Lewandowski

[11] Patent Number: 5,083,672

[45] Date of Patent: Jan. 28, 1992

[54] CLOSURE DEVICE FOR CONTAINERS

[76] Inventor: Eugene L. Lewandowski, R.R. 1, Box 190, Loup City, Nebr. 68853

[21] Appl. No.: 633,326

[22] Filed: Dec. 24, 1990

[51] Int. Cl.[5] ..... B65D 47/26

[52] U.S. Cl. ..... 215/322; 220/254; 222/561

[58] Field of Search ..... 215/311, 322; 220/254, 220/345, 351, 360; 222/518, 559, 561, 568

[56] References Cited

U.S. PATENT DOCUMENTS

| | | | |
|---|---|---|---|
| 427,635 | 0/1890 | Sutton . | |
| 672,641 | 4/1901 | Hirt . | |
| 872,536 | 12/1907 | Nystrom . | |
| 1,478,754 | 12/1923 | Moore . | |
| 1,488,229 | 3/1924 | Burns . | |
| 1,616,077 | 2/1927 | Curtis . | |
| 1,701,971 | 2/1929 | Chesson . | |
| 1,737,014 | 11/1929 | Lindgren . | |
| 1,737,548 | 12/1929 | Arvidson . | |
| 1,800,774 | 4/1931 | Bosecker | 222/561 X |
| 1,813,131 | 7/1931 | Andrassy . | |
| 1,835,448 | 12/1931 | Alland . | |
| 1,862,870 | 6/1932 | Tiscornia . | |
| 1,871,640 | 8/1932 | Weaver . | |
| 1,943,217 | 1/1934 | Godfrey, Jr. | 221/16 |
| 2,244,071 | 6/1941 | Landrus | 222/561 X |
| 2,320,484 | 6/1943 | Straub | 222/561 X |
| 2,434,706 | 1/1948 | Malyszko | 220/345 X |
| 2,445,395 | 7/1948 | Greene et al. | 215/311 X |
| 2,464,030 | 3/1949 | Engstrom | 222/287 |
| 2,480,733 | 8/1949 | Hermani | 220/254 X |
| 2,555,459 | 6/1951 | Seufer | 222/561 |
| 2,626,089 | 1/1953 | Osfar | 222/511 |
| 2,665,038 | 1/1954 | Fowler | 222/561 |
| 2,715,485 | 8/1955 | Bernhardt | 222/559 X |
| 2,723,773 | 11/1955 | Greene | 215/311 X |
| 2,746,656 | 5/1956 | Bradshaw | 222/561 |
| 2,757,859 | 8/1956 | Holland | 220/254 X |
| 2,781,955 | 2/1957 | Kidd | 222/436 |
| 2,784,884 | 3/1957 | Borie, Jr. | 222/336 |
| 2,808,186 | 10/1957 | Kates | 222/561 |
| 3,105,620 | 10/1963 | Atkins et al. | 222/342 |
| 3,147,824 | 9/1964 | Henderson | 184/88 |
| 3,302,644 | 2/1967 | Kennedy et al. | 215/311 X |
| 3,332,586 | 7/1967 | Amburgey | 220/345 X |
| 3,376,582 | 4/1968 | Samuels | 222/488 |
| 3,409,189 | 11/1968 | McKeand, Jr. | 222/561 |
| 3,540,466 | 11/1970 | Ilieff | 137/327 |
| 3,792,803 | 2/1974 | Kessler | 222/511 |
| 3,831,825 | 8/1974 | Kutzer et al. | 222/561 |
| 3,887,124 | 6/1975 | Skau | 229/7 |
| 4,331,266 | 5/1982 | Bond | 222/107 |
| 4,583,668 | 4/1986 | Maynard, Jr. | 222/529 |
| 4,600,125 | 7/1986 | Maynard, Jr. | 222/81 |
| 4,664,139 | 5/1987 | Pfeiffer | 137/240 |
| 4,856,681 | 8/1989 | Murray | 222/158 |
| 4,884,600 | 12/1989 | Wilson | 141/1 |

*Primary Examiner*—Gary E. Elkins
*Assistant Examiner*—Vanessa Caretto
*Attorney, Agent, or Firm*—Nixon & Vanderhye

[57] ABSTRACT

A closure device includes a substantially planar body member having a rectilinear slot receiving a slide element. Provided on one side of the body is an internally threaded flange defining an inlet port and a funnel projects from the opposite side of the body terminating in an externally threaded outlet port. A pusher connects with the slide element through a slot in the planar body to move the slide element between positions occluding the channel between the inlet and outlet ports and opening the channel. The internally threaded flange and externally threaded funnel are complementarily threaded such that the flange may be threaded about the externally threaded opening of a container and the cap normally threaded about the container opening may be threaded to the outlet port of the closure device to seal the closure device when the latter is left on the container. After the closure device is applied to the container, the slide element is pushed to close the opening and the container is inverted to align the outlet port with a receiving orifice. The slide element is then moved to the open position to permit flow of the container contents to the receiving orifice.

20 Claims, 1 Drawing Sheet

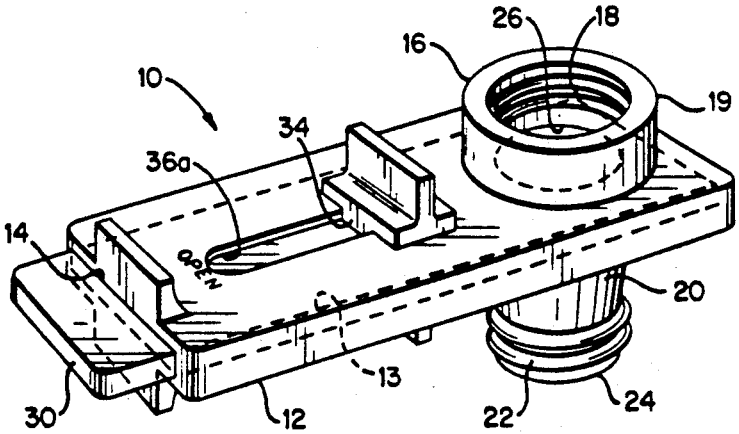
FIG. 1
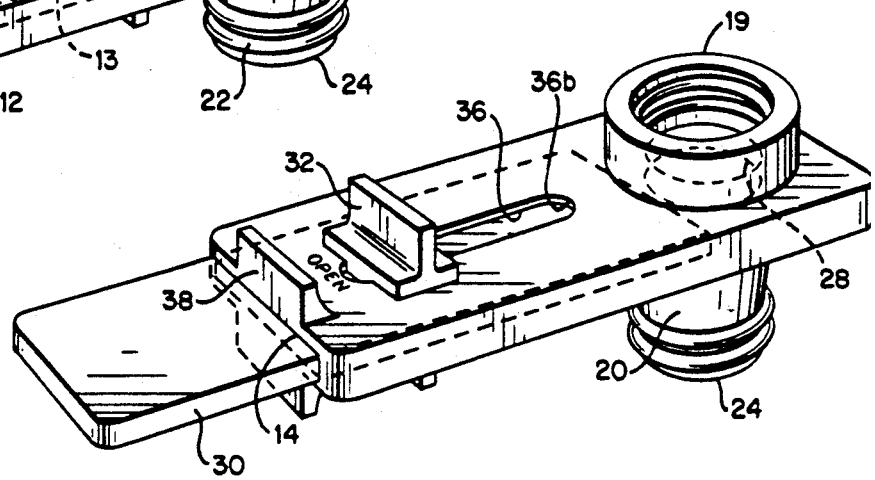
FIG. 2
FIG. 3
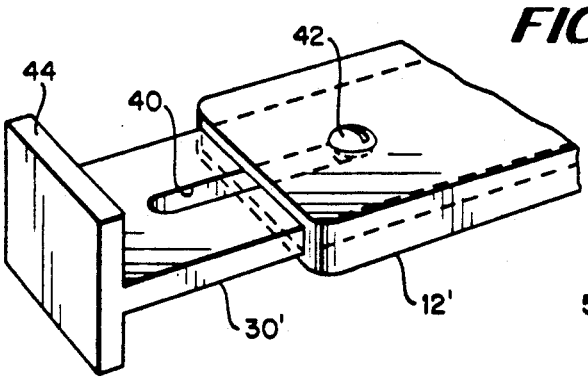
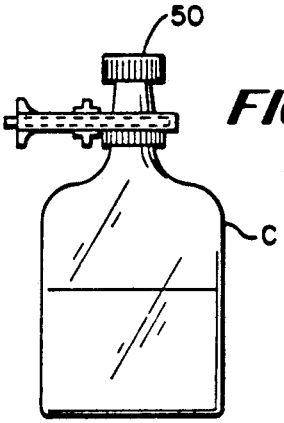
FIG. 4
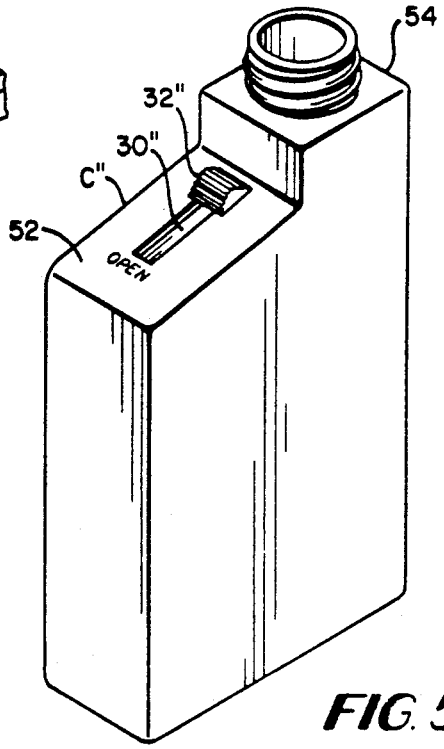
FIG. 5

CLOSURE DEVICE FOR CONTAINERS

BACKGROUND AND SUMMARY OF THE INVENTION

The present invention relates to a closure device for containers and particularly relates to a closure device which selectively enables and prevents flow of the contents of the container through the container opening to prevent spillage when directing the container into juxtaposition with a receiving orifice.

Most containers for dispensing liquid, solids and the like have their dispensing openings located at the top or adjacent to the top of the container. To pour its contents, the container is more or less gradually inclined or inverted until the contents reach the container opening, at which time the contents flow from the container through that opening in the form of a small stream. While in many applications, it is not necessary that the contents stream being dispensed from the container be accurately directed, there are a substantial number of situations where the inability to accurately direct the contents emerging from the container opening causes the contents to be spilled or otherwise wasted.

A typical example of the foregoing is a container for motor oils and the efforts to pour the oil directly from the container into the engine oil filler opening. Conventionally, these containers are formed of plastic and have a single opening at the top of the container. The opening is normally sealed by a threaded plastic cap which can be reapplied to the container to reseal it. When it becomes necessary to use the motor oil, the container must be inverted and the stream of motor oil issuing from the container opening directed into the engine oil filler opening. As is well known, the latter opening is small in diameter and oftentimes it is not possible, due to engine obstructions, to locate the container such that it may be moved close to the filler opening before the oil container is inverted for pouring. Consequently, when the container is inverted and moved to locate the container opening in the oil filler opening, oil typically spills onto the engine. Thus, not only is motor oil lost, but the oil may flow onto hot engine parts, creating smoke and fumes, and in general, causes a mess, requiring clean-up.

Of course, valves for use on closure devices for containers are well known and have applicability to a wide range of materials to be dispensed and to various types of containers as well. However, most such valves require a relatively complex mechanical construction for sealing the container. That, in turn, has led to rather expensive devices to prevent leakage. All that is actually necessary in most situations is for the valve closure device to substantially seal the container outlet during the short time interval the container is being inverted and its outlet directed to a receiving orifice. Absolute seals are not required.

In accordance with one aspect of the present invention, there is provided a closure device which is releasably attachable to the container about its top opening and selectively operable to substantially seal the container opening during inversion of the container and permit flow after the pouring spout or funnel of the closure device is aligned with the receiving orifice whereby spillage of the container contents is precluded. More specifically, the closure device preferably has a substantially planar body with an internally threaded flange projecting to one side of the body for threaded reception about the top opening of the container. Thus, the flange of the closure device defines an inlet port for receiving the contents, e.g., liquid, from the container upon its inversion.

On the opposite side of the planar body and opposite the flange, there is provided an outlet port. Preferably, the outlet port is formed on the distal end of an elongated pouring spout or sleeve in the form of a funnel which projects from the planar body and defines a pouring channel. The distal end of the sleeve is externally threaded, for reasons discussed hereinafter. Thus, the closure device includes an inlet port in communication with the outlet port through the channel. In accordance with the present invention, the communication between the inlet and outlet ports is selectively opened and closed by a valve. Particularly, the valve includes a slide element slidable in a substantially rectilinear slot in the body and into and out of positions substantially sealing and opening the channel between the inlet and outlet ports of the closure member. In a preferred embodiment hereof, the slide element includes a pusher disposed along the outside of the closure body and connected to the slide element by a pin slidably engaged in a slot along the closure body. The opposite ends of the slot define the limits of movement of the slide element, thus defining its valve open and closed positions, respectively. Alternatively, the pusher may be provided at the distal end of the slide element outside the closure body.

In use, the container for the liquid is opened by removing its sealing cap. The closure device hereof is then applied to the container opening by screw-threading the flange defining the inlet port of the closure device about the container opening. Prior to inverting the container, the slide element is displaced by the pusher into a valve-closed position substantially occluding the channel between the inlet port and the outlet port of the closure device. The container is then inverted and the outlet port of the closure device is located in juxtaposition to the liquid receiving orifice, i.e., the funnel of the closure device is located within the confines of such orifice. When so located, the pusher is displaced in a direction to slide the element to the valve-open position, thereby enabling the contents of the container to pass through the container opening, inlet port, channel including the slot and the outlet port into the receiving orifice.

In a preferred form of the present invention, the sleeve defining the outlet port is externally threaded. The threads are provided in such size and pitch that they match the internal threads of the cap used to seal the container. Consequently, the closure device, once applied to the container, may remain on the container and the container resealed by applying the container cap to the externally threaded sleeve defining the outlet port of the closure device. Thus, if only a portion of the contents of the container are poured therefrom, simply by applying the cap of the container to the closure device, the container may be effectively resealed for later reuse. From the foregoing, it will therefore be appreciated that the external threads about the outlet port of the closure device and the internal threads about the inlet port thereof are complementary to one another.

In a further aspect of the present invention, the closure device may be incorporated within the container itself. Thus, the slide element may be disposed internally of the container to open and close the passage within the neck of the container. In this manner, the container may be inverted, with the slide element in the closed position, thereby preventing the container contents from flowing out of the container opening until the outlet port of the closure device is positioned over the receiving orifice. At that time, the pusher, attached through a slot in the container wall to the slide element, is displaced to move the slide element into the valve-open position, enabling the contents to flow from the container through the closure device and into the orifice. Again, the cap for the container may be reused to seal the container in the event that not all of its contents are poured from the container.

In a preferred embodiment according to the present invention, there is provided a device for releasable attachment to a container having an opening to selectively enable and prevent flow of the contents of the container through the container opening, the device comprising a body defining a flow channel and means carried by the body defining an inlet port for the flow channel on one side of the body and an outlet port for the channel on the opposite side of the body. Also provided are means carried by the body adjacent the inlet port for releasably securing the device and the container one to the other to provide communication between the flow channel and the container opening through the inlet port. A closure element is slidably carried by the body for movement between a first position in which a portion of the slidable closure element obstructs the channel between the inlet and outlet ports to prevent flow from the container through the channel and a second position removed from the channel to enable flow from the container through the channel, Means are also carried by the body for guiding the closure element for movement between the first and second positions. An actuator is provided for sliding the closure element from one of the first and second positions thereof to the other of the first and second positions thereof.

In a further preferred embodiment according to the present invention, there is provided a device for releasable attachment to a container having an opening to selectively enable and prevent flow of the contents of the container through the container opening, the device comprising a body defining a flow channel, means carried by the body defining respective inlet and outlet ports for the flow channel, an internally threaded member in part defining the inlet port for releasably securing the device and the container one to the other and providing communication between the flow channel and the container opening. An element is carried by the body for movement between a first position in which a portion of the element obstructs the channel between the inlet and outlet ports to prevent flow from the container through the channel and a second position to enable flow from the container through the channel. An actuator is for moving the element from one of the first and second positions thereof to the other of the first and second positions thereof and external threads are carried by the body about the outlet port, the internal threads and the external threads being complementary to one another.

Accordingly, it is a primary object of the present invention to provide a novel and improved closure device for a container for selectively enabling and preventing flow of the contents of the container during inversion thereof and alignment of the container opening with a receiving orifice, whereby the contents of the container may be accurately dispensed without spillage into a receiving orifice.

These and further objects and advantages of the present invention will become more apparent upon reference to the following specification, appended claims and drawings.

BRIEF DESCRIPTION OF THE DRAWING FIGURES

FIG. 1 is a perspective view of a closure device constructed in accordance with the present invention and illustrating the closure device in a valve-closed position;

FIG. 2 is a view similar to FIG. 1 illustrating the closure device hereof in a valve-open position;

FIG. 3 is a fragmentary enlarged perspective view illustrating a further form of a closure device according to the present invention;

FIG. 4 is a side elevational view of a container for liquids having a closure device according to the present invention disposed thereon and resealed; and FIG. 5 is a perspective view of a container integrally incorporating the closure device of the present invention in the container.

DETAILED DESCRIPTION OF THE DRAWING FIGURES

Reference will now be made in detail to a present preferred embodiment of the invention, an example of which is illustrated in the accompanying drawings.

Referring now to the drawings, particularly to FIGS. 1 and 2, there is illustrated a closure device constructed in accordance with the present invention and generally designated 10. Closure device 10 includes a closure body 12 in the form of a flat, substantially linearly extending, plate. Plate body 12 has a substantially rectilinear slot or recess 13 extending substantially throughout its full length and opening through one end thereof at 14. The slot 13 extends to a location just short of the opposite end of plate 12 such that the slot 13 is open at one end and closed at its opposite end. Of course, the side and top walls of the plate body 12 define the slot between its opposite ends. Alternatively, the slot 13 could lie wholly within body 12, i.e., the opposite ends of the slot are closed by the opposite ends of the body as described further hereinafter.

On one side of plate body 12, means are provided for releasably connecting the closure device 10 and a container, for example, the container C illustrated in FIG. 4. Preferably, such means includes an annulus or annular flange 16 which projects to one side of plate body 12. Flange 16 is internally threaded at 18 for threaded engagement with the male threads about the neck of container C defining the opening in the container. The annulus or annular flange 16 also defines an inlet port 19 for closure device 10 as will become apparent from the ensuing description.

On the opposite side of plate body 12, there is provided a sleeve 20, preferably funnel-shaped, which projects from plate body 12 and terminates at its distal end in an outlet port 24, port 24 being further defined by external threads 22 about sleeve 20. The interior of annulus 16, i.e., the inlet port 19, communicates with slot 13 in plate body 12 through an opening 26 defined in the corresponding surface of plate body 12. Similarly, sleeve 20 communicates with slot 13 through an opening 28 defined through the lower wall of plate 12. Consequently, a through-passage for communicating material, e.g., liquid, from one side of closure device 10 to the opposite side is provided. Particularly, the through-passage includes the inlet port 19 defined by the annulus 16, the opening 26, the slot 13, the opening 28, and the sleeve 20, which terminates at outlet port 24.

Disposed within slot 13 is a slide element 30. Slide element 30 substantially fills slot 13 and is substantially linearly slidable therein between a valve-closed position wherein slide 30 is disposed between openings 26 and 28 to substantially occlude the passage through the closure member and a position, as illustrated in FIG. 2, wherein the distal end of the slide lies in a position spaced from openings 26, 28, thereby permitting passage of material, e.g., liquid, through the closure device hereof.

To facilitate opening and closing the valve closure member, the slide element 30 is provided with a pusher 32 connected to it by a pin 34. Pusher 32 slides over the outside surface of the plate body 12 and the pin slides in a slot 36 formed through the outside surface of plate 12. The ends of slots 36 provide stops for pin 34 whereby the extreme positions of slide element 30 are defined, the slot end **36*a* preventing the slide element 30 from being removed from the plate 12. The opposite slot end 36*b* limits the movement of the slide element 30 in the opposite direction or, alternatively, the plate end may butt against the inside surface of the slot at its distal end. To facilitate the manipulation of the closure member when applied to a container, a pair of projections 38 are provided along opposite sides of the proximal end of plate body 12. In this manner, plate body 12** may be grasped and the pusher element displaced toward and away from the valve-closed position.

In an alternative form of the invention illustrated in FIG. 3, the slide element 30' may be provided with a slot 40. The plate body 12' may be provided with a pin or screw 42 extending from one side thereof to the opposite side through slot 40. The proximal end of slide element 30' may be provided with flanges 44. Thus, by sliding slide element 30' toward and away from plate 12', the slide element 30' is displaceable between valve-closed and valve-open positions, respectively, with the slot 40 and pin 42 cooperating to define the limits of sliding movement of slide element 30' relative to plate 12'.

In a still further form, the slot 13 may be closed at opposite ends with slide element 30 lying wholly within slot 13. The slide element would therefore have a length shorter than the length of the slot and would be slidable in the slot between positions opening and closing the channel between the inlet and outlet ports 19 and 24, respectively.

In use, the cap 50 for the container C, cap 50 being illustrated in FIG. 4 as applied to the closure device 10 as described hereinafter, is unthreaded from the neck of the container. Closure device 10 is then applied directly to container C by threading the internal threads 18 of annulus 16 about the external threads of the container neck. Slide element 30 is then displaced into the valve-closed position by displacing pusher 32 toward the annulus 16. Thus, the flow passage through the closure device is occluded. The container may then be inverted and the outlet port 24 aligned with a receiving orifice, not shown. Once aligned, pusher 32 may be displaced rearwardly away from the annulus 16 moving slide element 30 to a position to open the fluid passage between the inlet and outlet ports 19 and 24, respectively, enabling the contents of the container, e.g., liquid, to be transmitted from container C, through the passage in the closure device, and into the receiving orifice.

In the event that less than the entirety of the contents of the container requires dispensing, the container with the attached closure device may simply be removed from the receiving orifice and disposed in its upright position. Alternatively, and when the container is still inverted, the slide element 30 may be displaced into the position closing the passage between the inlet and outlet ports, 19 and 24, respectively, thereby substantially sealing the passage and substantially preventing further transmission of the contents of the container through the closure device into the orifice. The container can then be disposed in its upright condition.

Also, in order to preserve the remaining contents of the container and to substantially seal those contents from the environment, the closure device may remain on the container. To seal the contents, the container cap 50 may be threaded about the outlet port 24 and particularly about external threads 22 as illustrated in FIG. 4. Thus, by maintaining the slide element 30 in the valve-closed position and capping the closure member with the container cap, a double-seal is provided. Alternatively the slide element 30 may lie in the valve-open position during storage with solely the cap 50 affording the substantial seal for the container.

It will be appreciated therefore that the size and pitch of the threads 18 and 22 about the inlet and outlet ports in relation to one another and to the threads of cap 50 form a significant aspect of the present invention. Because cap 50 is threadable on both the container neck and about the threads 22 of the closure device and also because threads 18 are threadable about the threads of the container neck, the threads 18 and 22 are necessarily complementary one to the other. This permits the ready resealing of the container with the closure device applied, as desirable, and where a substantial seal for the contents remaining in the container is desired.

It will be appreciated that the slide element and body cooperate to provide a substantial, but less then perfect, seal when the slide element lies in the valve-closed position. However the seal is effected for the limited time necessary to invert the container and commence pouring or, conversely, to seal the container when pouring and reinvert the container to its upright position. By recognizing that an absolute seal is not necessary, the closure device hereof may be fabricated much more inexpensively. For example, the closure device hereof may be formed of molded plastic parts inert to the material dispensed. Other suitable materials, of course, may be utilized.

Referring now to FIG. 5 there is illustrated a container C" wherein the closure device hereof is built into and forms an integral part of the container. The slide element 30" is disposed for sliding movement along the underside of the flat upper interior surface of container C" into and out of positions sealing and opening the passage through the neck 54 of the container. In this form, the upper surfaces of the body may comprise the upper surface 52 of container C". The lower surface need not be complete and, for example, may comprise only tracks for receiving and guiding the slide element 30". Additionally, the container opening may be defined only by neck 54 whereby, in this form, the annulus and funnel on opposite sides of the body in the preceding embodiment are omitted. Thus, by using pusher element 32", the slide element 30" can be disposed between positions opening and closing the passage through the neck 54 and the container C" may then be used similarly as in the prior embodiment.

It will be appreciated that the pushers are illustrated as lying on both sides of body 12, thus enabling the closure device to be operated from either side of body 12. However, the pushers may be mounted on only one side of the body, i.e., either side. However, where a mounting of the pusher on only one side is desired, it is preferable to mount it on the side of the body 12 which faces upwardly when the closure device is attached to the top of a container and the container is inverted. Thus, the pusher would be mounted on the side of the annular flange 16 which connects with the container opening so that the position of the pusher can be observed and its movement facilitated during pouring.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A device for releasable attachment to a container having an opening to selectively enable and prevent flow of the contents of the container through the container opening, said device comprising:

a body defining a flow channel;

means carried by said body defining an inlet port for said flow channel on one side of said body and an outlet port for said channel on the opposite side of said body;

means carried by said body adjacent said inlet port for releasably securing said device and the container one to the other to provide communication between said flow channel and the container opening through said inlet port;

a closure element slidably carried by said body for movement between a first position in which a portion of said slidable closure element obstructs said channel between said inlet and outlet ports to prevent flow from the container through said channel and a second position removed from said channel to enable flow from the container through said channel;

means carried by said body for guiding said closure element for movement between said first and second positions;

an actuator for sliding said closure element from one of said first and second positions thereof to the other of said first and second positions thereof;

a recess for slidably receiving said closure element and means carried by said body for limiting the sliding movement of said closure element between said first and second positions thereof;

said body includes a slot and a projection carried by said slidable closure element for sliding movement therewith and in said slot, said projection extending through said slot and terminating in said actuator for sliding said closure element between said first and second positions, said projection being engageable with said body at the opposite ends of said slot to limit the sliding movement of said closure element between said first and second positions thereof.

2. A device according to claim 1 wherein said releasable securement means includes a generally cylindrical flange having internal screw threads thereon for releasably securing said device for engaging external threads carried by the container whereby said device may be releasably secured to the container.

3. A device according to claim 2 wherein said outlet port includes a neck having external screw threads thereabout of a size and pitch complementary to the size and pitch of said internal screw threads, whereby a cap normally screw threaded to the container about its opening may be screw threaded to said external threads to seal the container with said device attached thereto.

4. A device according to claim 1 including internal and external threads about said inlet and outlet ports, respectively said internal and external threads being complementary to one another.

5. A device according to claim 1 in combination with said container, said container having a neck and external threads about said neck, a cap having internal threads for threaded engagement with the external threads about said neck.

6. A device according to claim 5 including internal and external threads about said inlet and outlet ports, respectively, said internal and external threads of said body being threadedly engageable with the external threads of said container opening and the internal threads of said cap whereby said body may be secured to said container and said cap secured to said device to seal the container.

7. A device for releasable attachment to a container having an opening to selectively enable and prevent flow of the contents of the container through the container opening, said device comprising:

a body defining a flow channel;

means carried by said body defining respective inlet and outlet ports for said flow channel;

an internally threaded member in part defining said inlet port for releasably securing said device and the container one to the other and providing communication between said flow channel and the container opening;

an element carried by said body for movement between a first position in which a portion of said element obstructs said channel between said inlet and outlet ports to prevent flow from the container through said channel and a second position to enable flow from the container through said channel;

an actuator for moving said element from one of said first and second positions thereof to the other of said first and second positions thereof; and external threads carried by said body about said outlet port, said internal threads and said external threads being complementary to one another.

8. A device according to claim 7 wherein said body includes a recess for receiving said element and means carried by said body for limiting the movement of said closure element between said first and second positions thereof.

9. A device according to claim 8 wherein said element includes a slot, and a projection carried by said body and disposed in said slot for engaging said element at the opposite ends of its slot to limit the movement thereof between said first and second positions.

10. A device according to claim 8 wherein said body includes a slot and a projection carried by said element for movement therewith and in said slot, said projection being engageable with said body at the opposite ends of said slot to limit the movement of said element between said first and second positions thereof.

11. A device according to claim 7 wherein said internally threaded member includes a generally cylindrical flange projecting outwardly of said body and having said internal screw threads thereon for releasably securing said device to and engaging external threads carried by the container.

12. A device according to claim 7 wherein said channel defines a linearly extending passage between said outlet and said inlet ports.

13. A device according to claim 7 in combination with said container, said container having a neck and external threads about said neck, a cap having internal threads for threaded engagement with the external threads about said neck.

14. A device according to claim 13 wherein said internal and external threads of said body are threadedly engageable with the external threads of said container opening and the internal threads of said cap whereby said body may be secured to said container and said cap secured to said device to seal the container.

15. A device for releasable attachment to a container having an opening to selectively enable and prevent flow of the contents of the container through the container opening, said device comprising:

a body defining a flow channel;

means carried by said body defining an inlet port for said flow channel on one side of said body and an outlet port for said channel on the opposite side of said body;

means carried by said body adjacent said inlet port for releasably securing said device and the container one of the other to provide communication between said flow channel and the container opening through said inlet port;

a closure element slidably carried by said body for movement between a first position in which a portion of said slidable closure element obstructs said channel between said inlet and outlet ports to prevent flow from the container through said channel and a second position removed from said channel to enable flow from the container through said channel;

means carried by said body for guiding said closure element for movement between said first and second positions;

an actuator for sliding said closure element from one of said first and second positions thereof to the other of said first and second positions thereof;

a recess for slidably receiving said closure element and means carried by said body for limiting the sliding movement of said closure element between said first and second positions thereof; and said slidable closure element including a slot, and a projection carried by said body and disposed in said slot for engaging the closure element at the opposite ends of its slot to limit the sliding movement of said closure element between said first and second positions thereof.

16. A device for releasable attachment to a container having an opening to selectively enable and prevent flow of the contents of the container through the container opening, said device comprising:

a body defining a flow channel;

means carried by said body defining an inlet port for said flow channel on one side of said body and an outlet port for said channel on the opposite side of said body;

means carried by said body adjacent said inlet port for releasably securing said device and the container one to the other to provide communication between said flow channel and the container opening through said inlet port;

a closure element slidably carried by said body for movement between a first position in which a portion of said slidable closure element obstructs said channel between said inlet and outlet ports to prevent flow from the container through said channel and a second position removed from said channel to enable flow from the container through said channel;

means carried by said body for guiding said closure element for movement between said first and second positions;

an actuator for sliding said closure element from one of said first and second positions thereof to the other of said first and second positions thereof;

said releasable securing means including a generally cylindrical flange having internal screw threads thereon for releasable engagement with external threads carried by the container whereby said device may be releasably secured to the container; and said outlet port including a neck having external screw threads thereabout of a size and pitch complementary to the size and pitch of said internal screw threads, whereby a cap normally screw threaded to the container about its opening may be screw threaded to said external threads to seal the container with said device attached thereto.

17. A device according to claim 16 wherein said channel defines a linearly extending passage between said outlet and said inlet ports.

18. A device according to claim 16 wherein said body includes a slot and a projection carried by said slidable closure element for sliding movement therewith and in said slot, said projection being engageable with said body at the opposite ends of said slot to limit the sliding movement of said closure element between said first and second positions thereof.

19. A device for releasable attachment to a container having an opening to selectively enable and prevent flow of the contents of the container through the container opening, said device comprising:

a body defining a flow channel;

means carried by said body defining an inlet port for said flow channel on one side of said body and an outlet port for said channel on the opposite side of said body;

means carried by said body adjacent said inlet port for releasably securing said device and the container one to the other to provide communication between said flow channel and the container opening through said inlet port;

a closure element slidably carried by said body for movement between a first position in which a portion of said slidable closure element obstructs said channel between said inlet and outlet ports to prevent flow from the container through said channel and a second position removed from said channel to enable flow from the container through said channel;

means carried by said body for guiding said closure element for movement between said first and second positions;

an actuator for sliding said closure element from one of said first and second positions thereof to the other of said first and second positions thereof; and internal and external threads about said inlet and outlet ports, respectively, said internal and external threads being complementary to one another.

20. A device for releasable attachment to and in combination with a container having an opening to selectively enable and prevent flow of the contents of the container through the container opening, said device comprising:

a body defining a flow channel;

means carried by said body defining an inlet port for said flow channel on one side of said body and an outlet port for said channel on the opposite side of said body;

means carried by said body adjacent said inlet port for releasably securing said device and the container one to the other to provide communication between said flow channel and the container opening through said inlet port;

a closure element slidably carried by said body for movement between a first position in which a portion of said slidable closure element obstructs said channel between said inlet and outlet ports to prevent flow from the container through said channel and a second position removed from said channel to enable flow from the container through said channel;

means carried by said body for guiding said closure element for movement between said first and second positions;

an actuator for sliding said closure element from one of said first and second positions thereof to the other of said first and second positions thereof;

said container having a neck and external threads about said neck, a cap having internal threads for threaded engagement with the external threads abut said neck; and internal and external threads about said inlet and outlet ports, respectively, said internal and external threads of said body being threadedly engageable with the external threads of said container opening and the internal threads of said cap whereby said body may be secured to said container and said cap secured to said device to seal the container.

* * * * *